US009846998B1

(12) United States Patent
Scott

(10) Patent No.: US 9,846,998 B1
(45) Date of Patent: Dec. 19, 2017

(54) LOCATION DETECTOR KIT

(71) Applicant: Robert Y. Scott, Harvey, IL (US)

(72) Inventor: Robert Y. Scott, Harvey, IL (US)

( * ) Notice: Subject to any disclaimer, the term of this patent is extended or adjusted under 35 U.S.C. 154(b) by 173 days.

(21) Appl. No.: 15/042,727

(22) Filed: Feb. 12, 2016

(51) Int. Cl.
*G08B 5/00* (2006.01)

(52) U.S. Cl.
CPC ..... *G08B 5/002* (2013.01)

(58) Field of Classification Search
CPC ..... G08B 5/00; G08B 5/002
USPC ..... 116/210
See application file for complete search history.

(56) References Cited

U.S. PATENT DOCUMENTS 3,174,455 A * 3/1965 Peterson ..... B64B 1/62 116/210
3,676,779 A * 7/1972 Faulring et al. ..... G08B 5/002 116/203
3,727,229 A * 4/1973 Clinger et al. ..... H01Q 1/082 116/210
3,951,260 A 4/1976 Frazee
4,052,955 A 10/1977 Haushalter
4,185,582 A * 1/1980 Bryant ..... G08B 5/002 116/210
4,696,252 A * 9/1987 Grill ..... B64B 1/40 116/210
5,095,845 A 3/1992 Murphy
5,429,244 A * 7/1995 McCreary ..... B64B 1/50 116/210
D436,880 S 1/2001 Dimand
6,178,915 B1 1/2001 Salandra
6,195,039 B1 2/2001 Glass, Jr.
6,244,209 B1 6/2001 Aguiar
6,359,568 B1 3/2002 Johnson
6,523,778 B2 2/2003 Key et al.
2005/0098088 A1* 5/2005 Mazza et al. ..... G08B 5/002 116/210
2006/0231012 A1 10/2006 Wamester et al.
2016/0229512 A1* 8/2016 Hall et al. ..... G08B 5/002

FOREIGN PATENT DOCUMENTS

GB 2325067 A * 11/1998 ..... G08B 5/002

* cited by examiner

*Primary Examiner* — R. A. Smith

(57) ABSTRACT

A location detector kit having a pouch with a cartridge containing a gas and the cartridge having a gas-release-activator, when the cartridge releases the gas through a gas straw on the cartridge, a rip cord is pulled from the outside of the pouch to release the gas, a deflated balloon then connects to the gas straw of the cartridge, when the balloon is inflated and rises above the pouch, the gas-release-activator breaks to allow the balloon to be fully deployed above the pouch, the cartridge is secured to the cable, and rises with the cable as the balloon rises and pulls the cable upward.

5 Claims, 3 Drawing Sheets

(ISO View)

(ISO View)

(Closed ISO View)

(Front View)

(Side View)

(Block Diagram)

LOCATION DETECTOR KIT

BACKGROUND OF THE INVENTION

The present invention is directed to a location detector kit. The location detector kit of the present invention provides an aid to individuals that need to be rescued from excursions such as camping trips, hiking, rock climbing and vacations.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1:
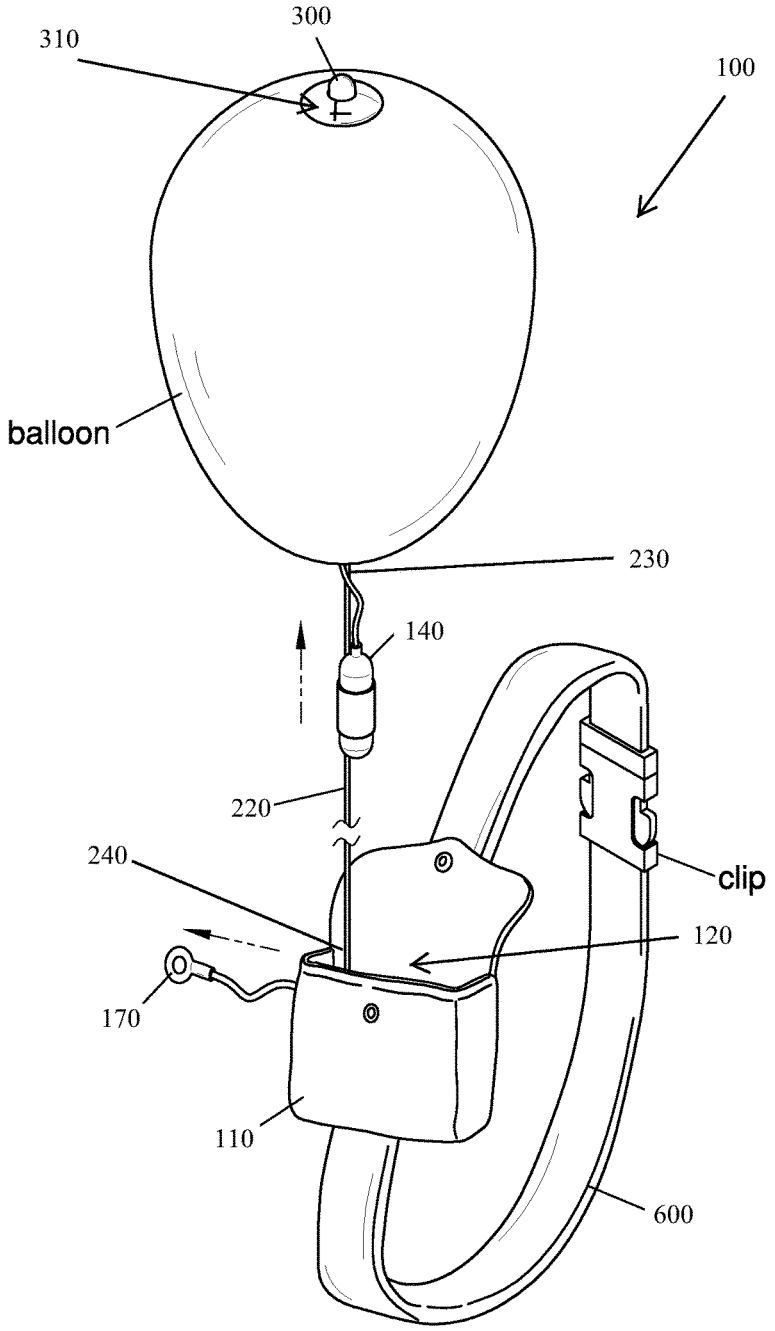
FIG. 1 shows a perspective view of the location detector kit.
Figure 2:
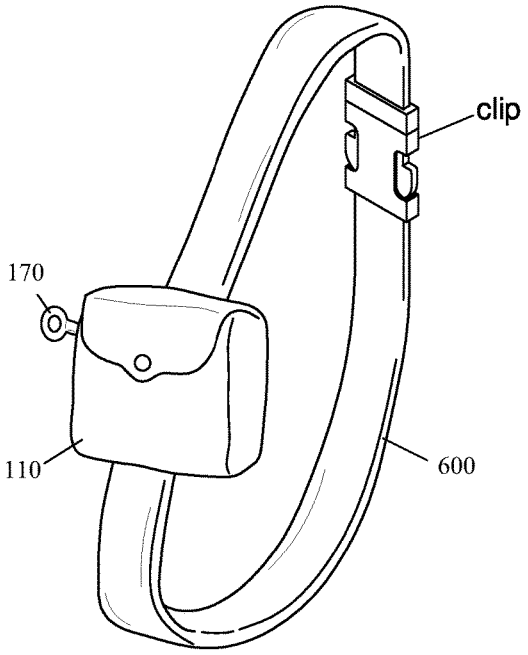
FIG. 2 shows another perspective view of the location detector kit.
Figure 3:
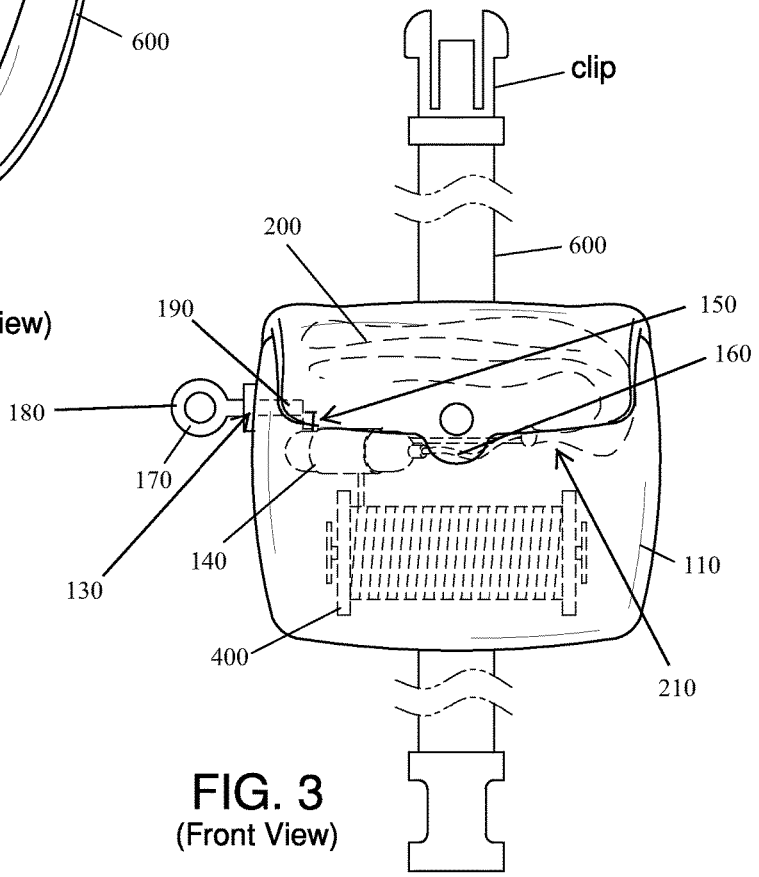
FIG. 3 shows a front view of the location detector kit.
Figure 4:
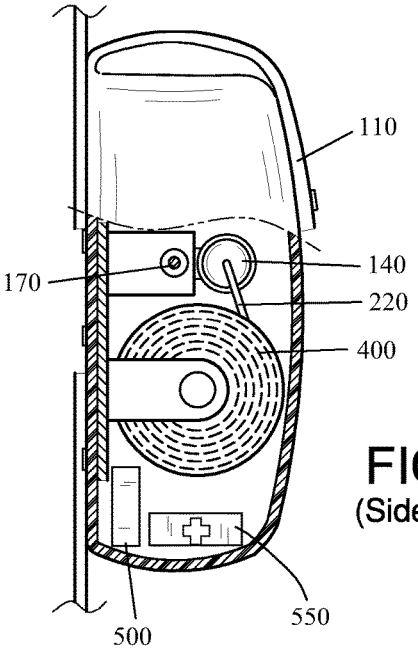
FIG. 4 shows a side view of the location detector kit.
Figure 5:
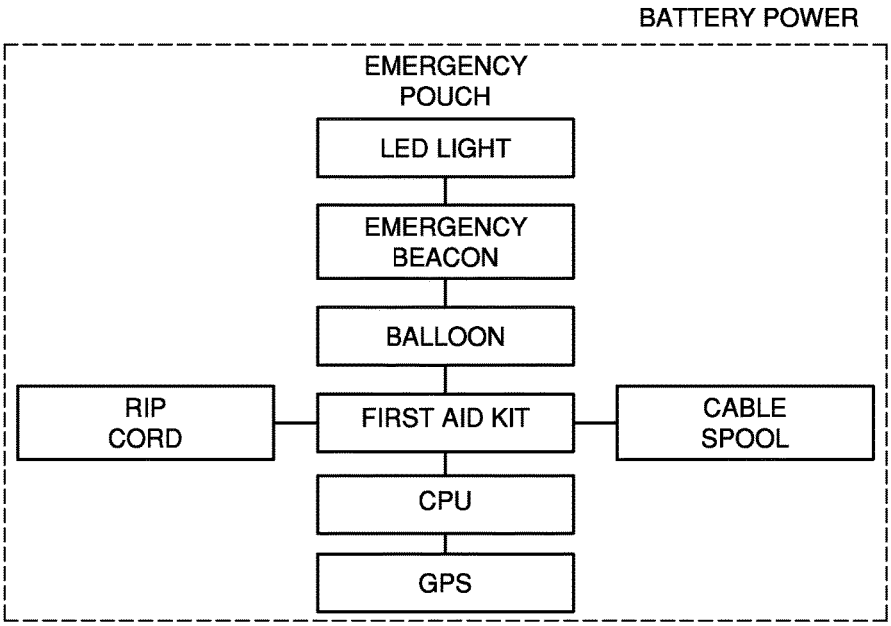
FIG. 5 shows a schematic chart of the location detector kit.

Referring now to FIG. 1-5, the present invention features a location detector kit 100 comprising a pouch 110 having a top opening 120 and a through hole 130. The kit further comprises a cartridge 140 containing a gas that is lighter than atmospheric air. The kit further comprises a gas-release-activator 150 operatively disposed on the cartridge, wherein when the gas-release-activator is tugged on, the cartridge releases the gas through a gas straw 160 disposed on the cartridge. A gas-release-activator 150 for use in conjunction with a gas cartridge in accordance with the present invention is well known to one of ordinary skill.

The kit further comprises a rip cord 170 having a first end 180 and a second end 190, the first end channels through the through hole of the bag and the second end operatively connects to the cartridge, wherein when the rip cord is pulled from the outside of the pouch, the second end of the rip cord tugs on the gas-release-activator of the cartridge to cause the cartridge to release the gas. The kit further comprises a deflated balloon 200 having a channel 210 that fluidly connects to the gas straw of the cartridge. The kit further comprises a cable 220 having a first end 230 and a second end 240, the first end being secured the balloon and the second end being secured to the pouch, wherein the second end of the rip cord is temporarily connected to the gas-release-activator, when the balloon is inflated by the gas and rises above the pouch a connection between the second end of the cord and the gas-release-activator breaks to allow the balloon to be fully deployed above the pouch; wherein the cartridge is secured to the cable, and the cartridge rises with the cable as the balloon rises and pulls the cable upward. This kit would aid to locate lost or stranded people on excursions such as camping trips, hiking, rock climbing and vacations. It would help to save lives because it would help to locate a person quickly and more efficiently.

In some embodiments, the kit comprises a battery powered LED (light emitting diode) light 300, wherein the LED light is disposed on the balloon and can be turned on via an on-off switch 310.

In some embodiments, the kit further comprises a spool 400 disposed within the pouch, the spool is for the cord to wrap around and be stored in the pouch.

In some embodiments, the kit further comprises a GPS (global positioning system) 500 disposed within the pouch.

In some embodiments, the pouch of the kit further comprises a strap 600.

In some embodiments, the kit further comprises a first aid kit 550.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

What is claimed is:

1. A location detector kit 100 comprising:

(a) a pouch 110 having a top opening 120 and a through hole 130;

(b) a cartridge 140 containing a gas that is lighter than atmospheric air;

(c) a gas-release-activator 150 operatively disposed on the cartridge, wherein when the gas-release-activator is tugged on, the cartridge releases the gas through a gas straw 160 disposed on the cartridge;

(d) a rip cord 170 having a first end 180 and a second end 190, the first end channels through the through hole of the bag and the second end operatively connects to the cartridge, wherein when the rip cord is pulled from the outside of the pouch, the second end of the rip cord tugs on the gas-release-activator of the cartridge to cause the cartridge to release the gas;

(e) a deflated balloon 200 having a channel 210 that fluidly connects to the gas straw of the cartridge;

(f) a cable 220 having a first end 230 and a second end 240, the first end being secured the balloon and the second end being secured to the pouch;

wherein the second end of the rip cord is temporarily connected to the gas-release-activator, when the balloon is inflated by the gas and rises above the pouch a connection between the second end of the cord and the gas-release-activator breaks to allow the balloon to be fully deployed above the pouch;

wherein the cartridge is secured to the cable, and the cartridge rises with the cable as the balloon rises and pulls the cable upward.

2. The kit of claim 1 further comprising a battery powered LED (light emitting diode) light 300, wherein the LED light is disposed on the balloon and can be turned on via an on-off switch 310.

3. The kit of claim 1 further comprising a spool 400 disposed within the pouch, the spool is for the cord to wrap around and be stored in the pouch.

4. The kit of claim 1 further comprising a GPS (global positioning system) 500 disposed within the pouch.

5. The kit of claim 1 wherein the pouch further comprises a strap 600.

* * * * *